US008508905B2

(12) United States Patent
Baek

(10) Patent No.: US 8,508,905 B2
(45) Date of Patent: Aug. 13, 2013

(54) COIL-DRIVING APPARATUS OF ELECTRONIC MAGNETIC CONTACTOR

(75) Inventor: Seung Moon Baek, Cheongju-si (KR)

(73) Assignee: LS Industrial Systems Co., Ltd., Seoul (KR)

( * ) Notice: Subject to any disclaimer, the term of this patent is extended or adjusted under 35 U.S.C. 154(b) by 820 days.

(21) Appl. No.: 12/042,103

(22) Filed: Mar. 4, 2008

(65) Prior Publication Data

US 2008/0218928 A1 Sep. 11, 2008

(30) Foreign Application Priority Data

Mar. 5, 2007 (KR) ..... 10-2007-0021272

(51) Int. Cl.
*H01H 47/00* (2006.01)

(52) U.S. Cl.
USPC ..... 361/139; 361/143

(58) Field of Classification Search
USPC ..... 361/143, 139
See application file for complete search history.

(56) References Cited

U.S. PATENT DOCUMENTS 4,851,661 A * 7/1989 Everett, Jr. ..... 250/221
6,873,125 B2 * 3/2005 Seima et al. ..... 318/400.09
7,042,692 B2 * 5/2006 Ueki et al. ..... 361/143
2004/0159776 A1 * 8/2004 Richard et al. ..... 250/214 R

FOREIGN PATENT DOCUMENTS

CN 1228912 9/1999

* cited by examiner

*Primary Examiner* — Rexford Barnie
*Assistant Examiner* — Tien Mai
(74) *Attorney, Agent, or Firm* — Lee, Hong, Degerman, Kang & Waimey

(57) ABSTRACT

A coil-driving apparatus of an electro magnetic contactor is disclosed, which replaces the main units in an analog scheme with those in a digital scheme using a PWM controller of low power consumption to reduce the number of the analog components, minimize power consumption, and controls a constant voltage that flows on the coil by receiving the feedback current flowing on the coil, whereby error and defect generation rates are reduced, and deterioration and burning of components are prevented.

3 Claims, 4 Drawing Sheets

COIL-DRIVING APPARATUS OF ELECTRONIC MAGNETIC CONTACTOR

CROSS-REFERENCE TO RELATED APPLICATION

The present application is based on, and claims priority from, Korean Application Number 10-2007-0021272 filed Mar. 5, 2007, the disclosure of which is incorporated herein by reference in its entirety.

BACKGROUND OF THE INVENTION

This description relates to a coil-driving apparatus of electronic magnetic contactor, and more particularly to a coil-driving apparatus of electronic magnetic contactor changing circuit units in an existing analog scheme into those in a digital scheme by means of a PWM (Pulse Width Modulation) controller of low power consumption to reduce the number of analog components and to minimize power consumption.

Generally, an electronic magnetic contactor, which is an apparatus connected to an electrical connection path to supply or block power to a load in a system such as a building, a factory, and a ship, etc., prevents the load from being burnt out.

The electronic magnetic contactor, which is equipment for opening and closing a contact point by using an electromagnetic principle, allows the contact point to be contacted when a current flows and allows the contact point to be separated when a current does not flow, by applying a constant voltage to a coil.

FIG. 1 is a block view showing a constitution of a coil-driving apparatus of a general electronic magnetic contactor.

Referring to FIG. 1, the coil-driving apparatus of the general electronic magnetic contactor includes an input filter unit 102, a rectifying unit 104, an input voltage detecting unit 106, a constant voltage unit 108, an operation control unit 110, an overvoltage prevention unit, a temperature compensating unit 120, a control voltage level controlling unit 122, a sawtooth generation unit 124, a PWM output unit 126, a switching unit 260, and a surge absorbing unit 280.

The input filter unit 102 absorbs a surge voltage to remove noise from a voltage inputted from an input terminal 100.

The rectifying unit 104 rectifies a voltage outputted from the input filter unit 102 to output a direct current power.

The input voltage detecting unit 106 detects a voltage level of the direct current power outputted from the rectifying unit 104.

The constant voltage unit 108 receives the direct current power outputted from the rectifying unit 104 to output a constant voltage. The rectifying unit 108 supplies a driving power for driving respective units.

The operation control unit 110 compares the voltage level detected by the input voltage detecting unit 106 with a pre-set reference voltage level and then outputs control signals according to the comparative results thereof. It is preferable that the pre-set reference voltage be generated through the constant voltage unit 108.

More specifically, the operation control unit 110 includes a comparing/judging unit 111 and a time determining unit 112, wherein the comparing/judging unit 111 compares the voltage level detected by the input voltage detecting unit 106 with the pre-set reference voltage level to output suction signals, when the voltage level of the input voltage detecting unit 106 is larger than the reference voltage level, and to output release signals when the voltage level of the input voltage detecting unit 106 is smaller than the reference voltage level. In other words, if the control signals outputted from the comparing/judging unit 110 are suction signals, the operation control unit 110 performs a suction operation, and if the control signals outputted from the comparing/judging unit 110 are release signals, the operation control unit 110 performs a release operation. When the comparing/judging unit 111 outputs the suction signals, the time determining unit 112 determines a maintenance time of the suction signals to transfer it to a control voltage level controlling unit 122. The reason is that since a large amount of current is generally needed at an early stage for contacting the contact point of the electronic magnetic contactor, the suction signals are continuously maintained for the pre-set time to provide the current so that the contact point can contact each other. Also, the time determining unit 112 transfers the release signals outputted from the comparing/judging unit 111 to the control voltage level controlling unit 122.

The overvoltage prevention unit and the temperature compensating unit 120 are configured of an overvoltage prevention unit and a temperature compensating unit. The overvoltage prevention unit controls the control voltage level controlling unit 122 not to generate signals having a predetermined level, when the voltage detected by the input voltage detecting unit 106 is larger than the pre-set voltage. The temperature compensating unit, which is configured of a sensor or a circuit measuring a peripheral temperature, generates control signals in order that the levels of the signals generated by the control voltage level controlling unit 122 depending on temperature change can be controlled.

The control voltage level controlling unit 122 generates signals having a predetermined level in order that a pulse width of PWM signals outputted from a PWM output unit 126 in response to the control signals inputted from the time determining unit 112 of the operation control unit 110 can be controlled.

The control voltage level controlling unit 112 neither controls the level of the signals nor outputs the signals by receiving the control signals of the overvoltage prevention unit and the temperature compensating unit 120.

The sawtooth generation unit 124 outputs sawtooth signals for a predetermined period as the control voltage level controlling unit 122 outputs the signals of a predetermined level.

The PWM (Pulse Width Modulation) output unit 126 compares the signals generated by the control voltage level controlling unit 122 with those outputted by the sawtooth generation unit 124, and then outputs PWM signals according to the comparative results thereof.

The switching unit 128 allows current flowing on a coil 130 to be conducted or to be blocked by being switched according to the PWM signals generated from the PWM output unit 126. In other words, the switching unit 128 is switched according to the PWM signals so that current flowing on the coil 130 can be controlled.

The surge absorbing unit 280 absorbs counter electromotive force generated from the coil 130.

In the general electronic magnetic contactor described above, many units are included for controlling the coil. In particular, main units for generating the PWM signals, such as the overvoltage prevention unit, the temperature compensating unit 120, the control voltage level controlling unit 122, the sawtooth generation unit 124, and the PWM output unit 126 are in an analog scheme whereby the analog components constituting the respective units becomes numerous to cause various problems.

First, circuits become complicated due to the components of the respective units, and a circuit board becomes large for inserting the components into the circuit substrate to that extent.

Also, errors occur due to use of the analog components and defect generation rate increases due to multiple analog components.

Also, current consumed in the circuit becomes large to generate much heat thereby the components are deteriorated or burnt.

Finally, there have been attempted to solve the above problems by using components having a small error range for the components constituting the respective units, such as the overvoltage prevention unit, the temperature compensating unit 120, the control voltage level controlling unit 122, the sawtooth generation unit 124, and the PWM output unit 126. However, these problems have not been easily solved due to expenses, power consumption and other reasons.

SUMMARY OF THE INVENTION

It is an object of the present invention to provide a coil-driving apparatus of an electronic magnetic contactor capable of miniaturizing a circuit board and reducing detect generation rate by reducing the number of components by replacing circuit units in an analog scheme conventionally used for generating PWM (Pulse Width Modulation) signals with those in a digital scheme using a PWM controller of low power consumption.

It is another object of the present invention to provide a coil-driving apparatus of an electronic magnetic contactor allowing a constant current to flow on a coil by being feedback with the current flowing on the coil to control the current.

It is another object of the present invention to provide a coil-driving apparatus of an electronic magnetic contactor preventing deterioration and burnt-out of components and having a high durability and reliability, by minimizing power consumption.

In order to accomplish the objects, there is provided a coil-driving apparatus of an electronic magnetic contactor comprising: an input power processing unit converting an inputted power to a direct current power; an input voltage detecting unit detecting a voltage level of the direct current power outputted from the input power processing unit; an operation control unit comparing the voltage level detected by the input voltage detecting unit with a pre-set reference voltage level and then generating control signals according to the comparative results thereof; a PWM (Pulse Width Modulation) controller outputting PWM signals by being feedback with a current flowing on a coil so that the current flowing on the coil can be controlled according to the feedback current and the control signals generated from the operation control unit; and a switching unit that is switched by the PWM signals outputted from the PWM controller to conduct or block the current flowing on the coil.

The operation control unit includes a comparing/judging unit comparing the voltage level detected by the input voltage detecting unit with the pre-set reference voltage level and generating suction signals in response to the comparative results thereof, and a time determining unit determining a maintenance time of the suction signals when the suction signals are generated from the comparing/judging unit.

The PWM controller is feedback with the current flowing on the coil.

As specifically described as above, with the present invention, the main units in an analog scheme, for generating PWM signals, are replaced by a PWM controller of low power consumption to reduce the number of the analog components and minimize power consumption. Furthermore, it is feedback with the current flowing on a coil to control constant current to be flown on the coil.

Therefore, it has effects to reduce malfunction and error generation rate by preventing deterioration and burning of components.

Finally, it has effects to implement a small-sized coil-driving apparatus of an electronic magnetic contactor having a high durability and reliability.

DETAILED DESCRIPTION OF THE EXEMPLARY EMBODIMENTS

Hereinafter, the present novel concept will be described in detail with reference to the accompanying drawings.

However, in describing the present invention, specific description thereof will be omitted, when it is judged that the specific description of the relevant well-known function or constitution may make the gist of the present description obscure.

Figure 2:
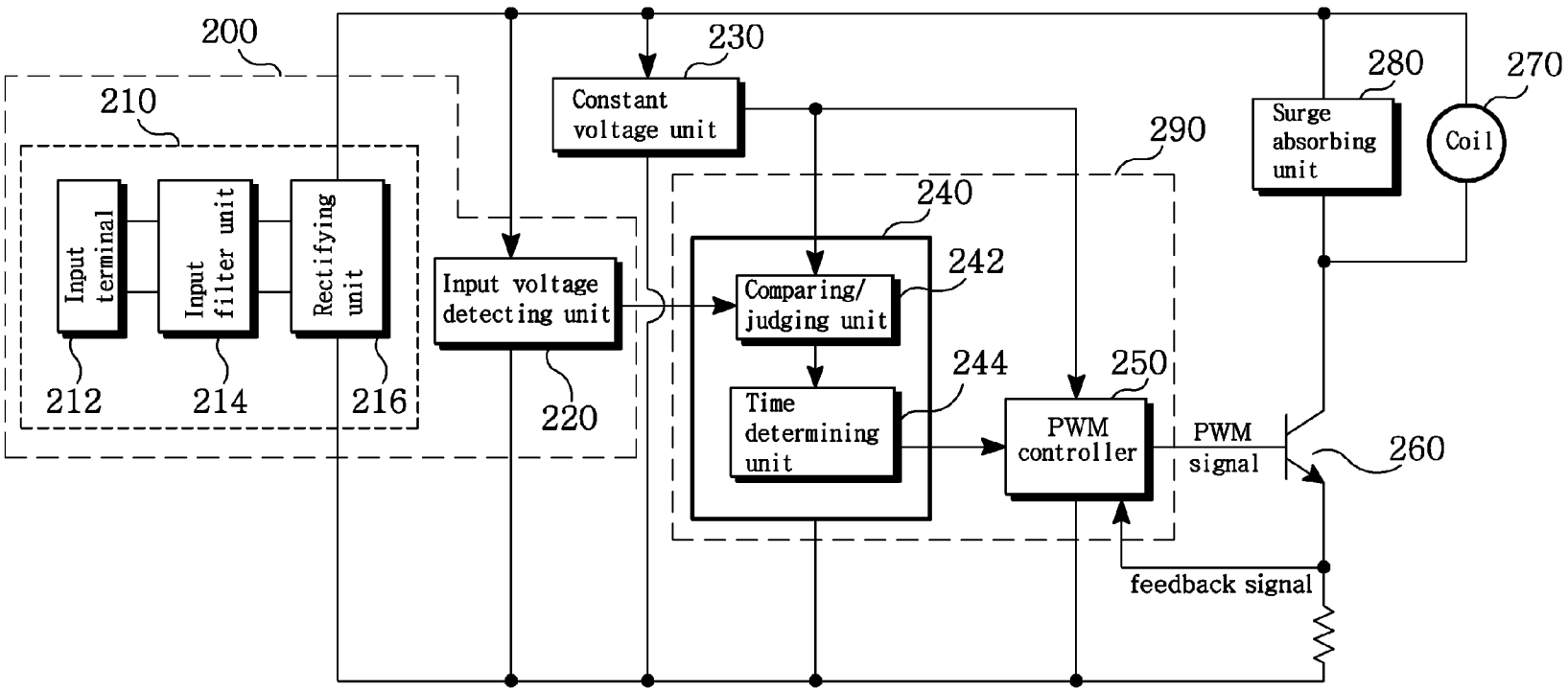
FIG. 2 is a block diagram showing a constitution of a coil-driving apparatus of an electronic magnetic contactor according to the present invention.
Figure 3:
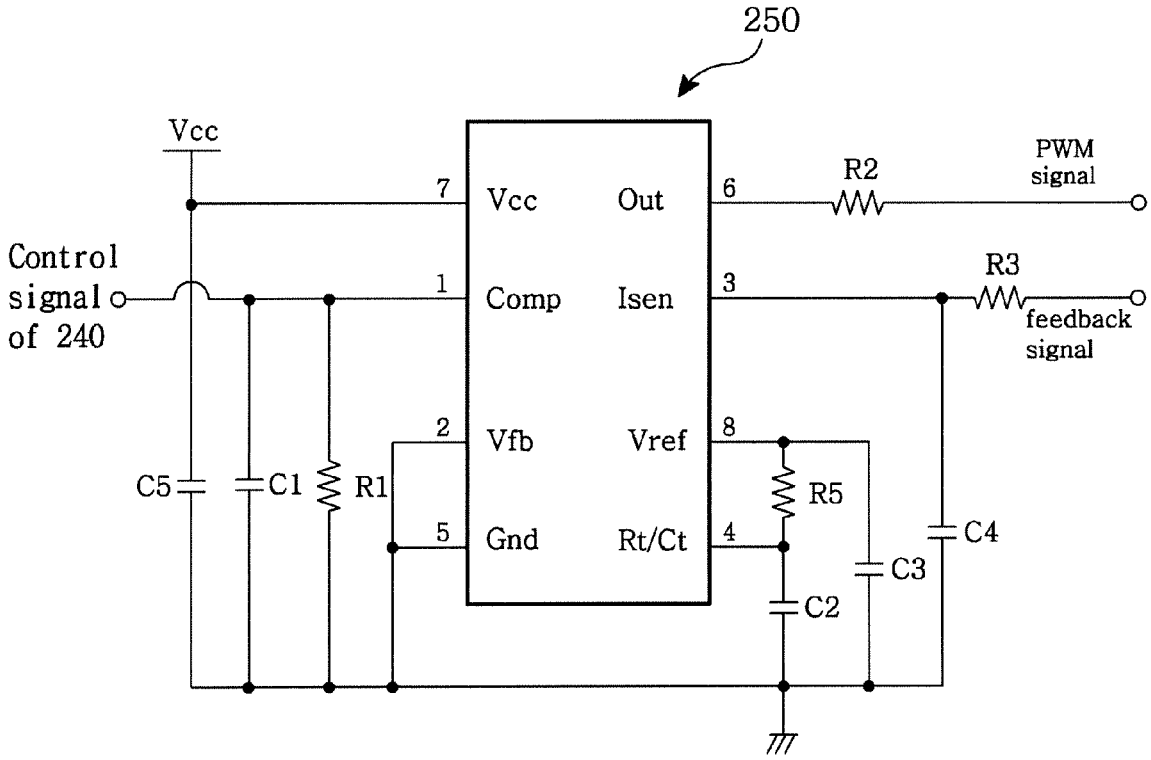
FIG. 3 shows an exemplary circuit constitution of the PWM controller of FIG. 2.

FIG. 2 is a block diagram showing a constitution of a coil-driving apparatus of an electronic magnetic contactor, and FIG. 3 is an exemplary circuit constitution of the PWM controller of FIG. 2.

Referring to FIG. 2, the coil-driving apparatus of the electronic magnetic contactor largely comprises: a voltage detecting unit 200; and a driving control unit 290, wherein the voltage detecting unit specifically includes an input power processing unit 210 and an input voltage detecting unit 220, and the driving control unit 290 includes an operation control unit 240 and a PWM controller 250. In addition, the coil-driving apparatus of the electronic magnetic contactor includes a constant voltage unit 230, a switching unit 260, and a surge absorbing unit 280.

The input power processing unit 210 includes an input terminal 212, an input filter unit 214 and a rectifying unit 216, wherein the input filter unit 214 absorbs a surge voltage in power inputted from the input terminal 212 and removes noise.

The rectifying unit 216 rectifies voltage outputted from the input filter unit 214 to output a direct current power.

The input voltage detecting unit 220 detects a voltage level of the direct current power outputted from the rectifying unit 216.

The constant voltage unit 230 receives the direct current power outputted from the rectifying unit 216 and divides the voltage of the input direct current power to output a constant voltage. The respective units are driven by means of the constant voltage generated by the constant voltage unit 230.

The operation control unit 240, configured of a comparing/judging unit 242 and a time determining unit 244, compares the voltage level detected by the input voltage detecting unit 220 with a pre-set reference voltage level and then outputs control signals according to the comparative results thereof. It is preferable that the pre-set reference voltage be generated through the constant voltage unit 230.

More specifically, the comparing/judging unit 242 compares the voltage level detected by the input voltage detecting unit 220 with the pre-set reference voltage level to output suction signals, when the voltage level of the input voltage detecting unit 220 is larger than the reference voltage level, and to output release signals when the voltage level of the input voltage detecting unit 220 is smaller than the reference voltage level.

The time determining unit 244 determines a maintenance time of the suction signals, when the suction signals are generated in the comparing/judging unit 242. As described above, the reason is that since a large amount of current is needed at an early stage for contacting the contact point of the electronic magnetic contactor, an appropriate amount of current may be supplied by lengthening the maintenance time of the suction signals and then shortening the maintenance time thereof after a predetermined time elapses. The time determining unit 244 transfers the release signals outputted by the comparing/judging unit 242 to a control voltage level controlling unit 122.

The PWM controller 250 receives the feedback current flowing on a coil 270 and controls width of the PWM signals in order that the current flowing on the coil 270 can be controlled according to the feedback current and the control signals generated by the operation control unit 240, thereby outputting the controlled PWM signals. The PWM controller 250 is a PWM control-only IC (Integrated Circuit).

Specifically reviewing the PWM controller 250 with reference to FIG. 3, the PWM controller 250 is driven by receiving the voltage outputted by the constant voltage unit 230 through a seventh pin, the control signals outputted by the operation control unit 240 are inputted through a first pin, and the current flowing on the coil 270 is feedback through a third pin. The PWM signals controlled by controlling the pulse width of the PWM signals in response to the control signals of the operation control unit 240 inputted through the first pin and the current value inputted through the third pin, are outputted through a sixth pin. The PWM controller 250 serves to function the same role as the sawtooth generation unit 124 of FIG. 1, through a circuit constitution of a eighth pin and a fourth pin thereof.

The switching unit 260 allows the current flowing on the coil 270 to be conducted or to be blocked by being switched in response to the control signals generated by the PWM controller 250.

The surge absorbing unit 280 absorbs the counter electromotive force generated by conduction or blocking of the current flowing on the coil 270. The surge absorbing unit 280 may be a flywheel circuit.

Summing up, the coil-driving apparatus according to the present disclosure is largely includes a voltage detecting unit 200 converting power input to a direct current power and detecting a voltage level of the direct current power and a driving control unit 290 controlling a current flowing on a coil through a PWM (Pulse Width Modulation) controller, which is a single element, according to the difference between the voltage level and a pre-set reference voltage level. In detail, the voltage detecting unit 200 includes an input power processing unit 210 converting a power input to a direct current power and an input voltage detecting unit 220 detecting a voltage level of the direct current power outputted by the input power processing unit 210, and the driving control unit 290 includes an operation control unit 240 comparing the voltage level with a pre-set reference voltage level and then generating control signals according to the comparative results thereof, a PWM controller 250 outputting PWM (Pulse Width Modulation) signals in order that the current flowing on the coil can be controlled according to the control signals generated by the operation controller, and a switching unit 260 allowing the current flowing on the coil to be conducted or to be blocked by being switched in response to the PWM signals outputted by the PWM controller 250. The operation control unit 240 includes a comparing/judging unit 242 comparing the voltage level detected by the input voltage detecting unit 220 with the pre-set reference voltage and then generating suction signals in response to the comparative results thereof, and a time determining unit 244 determining a maintenance time of the suction signals, when the suction signals are generated by the comparing/judging unit 242.

Figure 1:
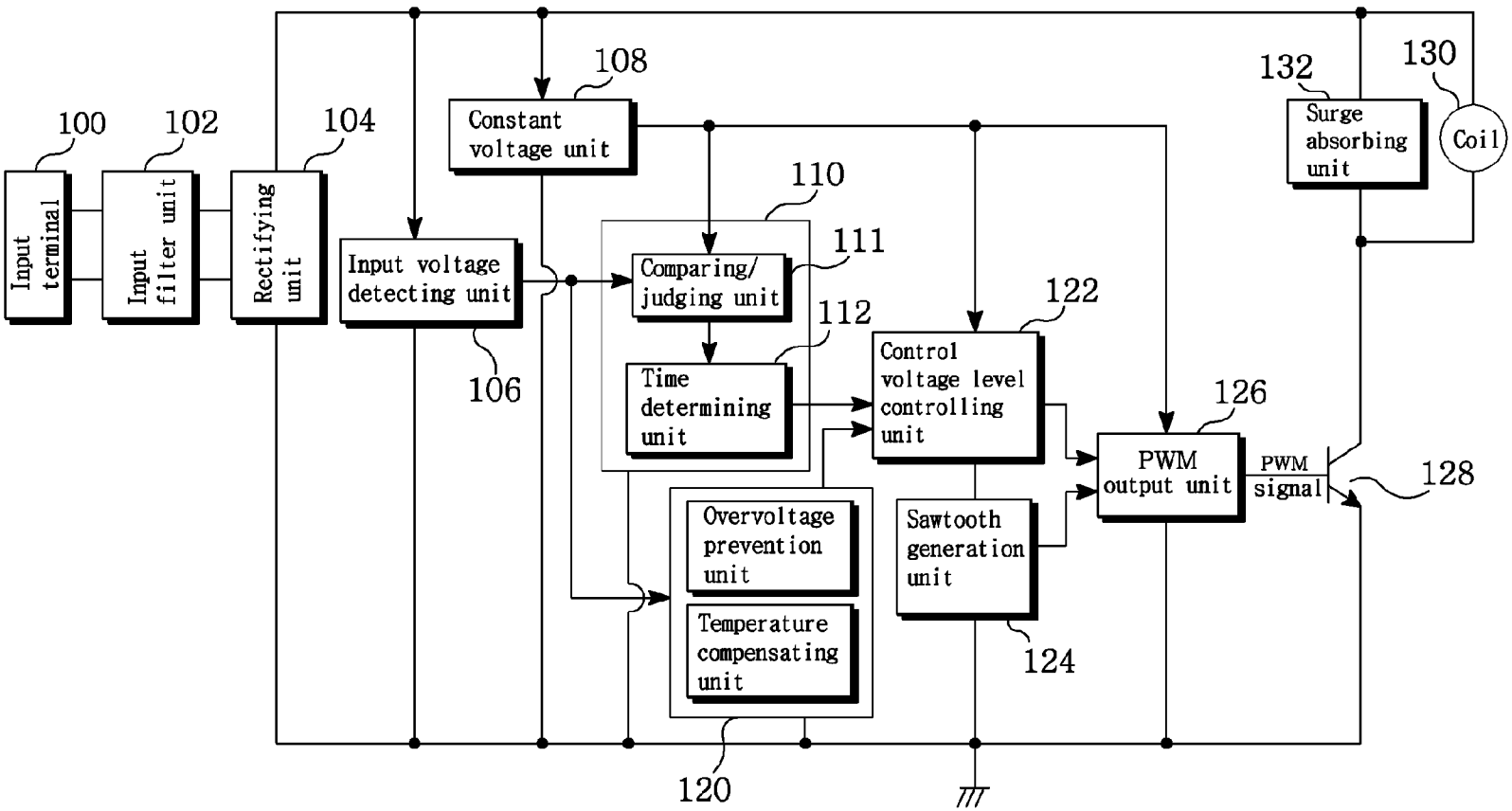
FIG. 1 ( PRIOR ART )
FIG. 1 is a block diagram showing a constitution of a general coil-driving apparatus of an electronic magnetic contactor.

Comparing FIG. 1 with FIG. 2 for explaining the coil-driving apparatus of the electronic magnetic contactor, the present concept replaces the main units in an analog scheme, for generating the PWM signals, used in FIG. 1, with those in a digital scheme using the PWM controller 250 of low power consumption, which is the PWM-only IC. The main units in an analog scheme include an overvoltage prevention unit and a temperature compensating unit 120, a control voltage level controlling unit 122, a sawtooth generation unit 124, and a PWM output unit 126.

Figure 4:
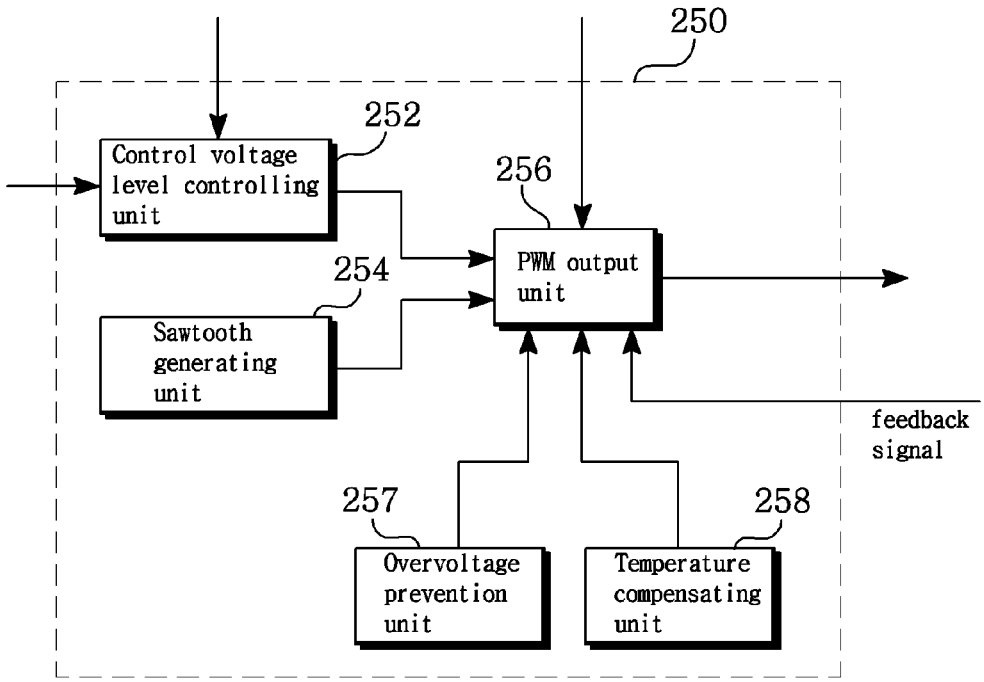
FIG. 4 shows a block diagram of the PWM controller of FIG. 2 according to one embodiment.

More specifically, the PWM controller 250 (see, e.q., FIG. 4), which is a single element, includes a control voltage level controlling unit 252 controlling a pulse width of PWM signals according to the difference between the voltage level and a pre-set reference voltage level, a sawtooth generation unit 254 outputting sawtooth signals at a predetermined period when the control voltage level controlling unit 252 operates, and a PWM output unit 256 comparing the signals outputted by the control voltage level controlling unit 252 and the sawtooth generation unit 254 and then outputting the PWM signals according to the results thereof. In addition, it is preferable that the PWM controller 250 further include an overvoltage prevention unit 257 suppressing an output of the control voltage level controlling unit 252 and a temperature compensating unit 258 compensating for the output signal level of the control voltage level controlling unit 252 according to temperature change, when the voltage level is larger than the pre-set allowed voltage level.

Although in FIG. 1, multiple analog components are used including the overvoltage prevention unit and the temperature compensating unit 120, the control voltage level controlling unit 122, the sawtooth generation unit 124, and the PWM output unit 126, only a few number of analog components including the PWM controller 250 are used in FIG. 2. Therefore, error generation rate and power consumption as well as expenses are minimized to reduce heat generation. In other words, a number of analog components in relation to the conventional PWM control are replaced by the PWM controller 250, which is a single element, making it possible to reduce power consumption.

Furthermore, the number of components to be inserted into a circuit board is limited to it possible to constitute a coil-driving apparatus of an electronic magnetic contactor in a compact circuit board.

Still furthermore, in the prior art, the PWM signals are generated in response to peripheral temperatures by the temperature compensating unit of the overvoltage prevention unit and the temperature compensating unit 120, the control voltage level controlling unit 122, and the sawtooth generation unit 124. However, in the present concept, the PWM controller receives the feedback current flowing on the coil 270

(current feedback manner) to generate the PWM control signals in response to the feedback current, making it possible to allow constant current to flow on the coil regardless of inputted voltages. In so ding, the present disclosure can remove unnecessary overvoltages, improve durability of the coil by preventing the coil degradation and constantly a maintaining suction force, and improve entire reliability as a result of reduction of abrasion of a contact point. Furthermore, a more precise control becomes possible.

Finally, although the prior art generates the PWM signals through circuit units in an analog scheme such as the overvoltage prevention unit and the temperature compensating unit 120, the control voltage level controlling unit 122, the sawtooth generation unit 124, and the PWM output unit 126, the present disclosure generates the PWM signals through the PWM controller 250, which is an IC used exclusively for PWM control, to allow a constant voltage to flow on the coil whereby a coil-driving apparatus of an electronic magnetic contactor having a high durability and reliability, can be embodied, thereby preventing deterioration and burnt-out of a coil and electronic components, etc.

Although the exemplary implementations are described in the foregoing, it will be apparent to those skilled in the art that various modifications and variations can be made without departing from the spirit or scope of the present novel concept. Thus, it is intended that the present disclosure covers the modifications and variations thereof, provided that they come within the scope of the appended claims and their equivalents.

What is claimed is:

1. A coil-driving apparatus of an electronic magnetic contactor, the coil-driving apparatus comprising:

a voltage detecting unit comprising an input power processing unit for converting an input power to a direct current power and an input voltage detecting unit for detecting a voltage level of the direct current power; and a driving control unit for controlling a current flowing through a coil via based on a difference between the detected voltage level and a pre-set reference voltage level, wherein the driving control unit comprises:

an operation control unit for performing a suction operation when the comparing unit generates the suction signals, the operation control unit comprising:

a comparing unit for comparing the detected voltage level with the pre-set reference voltage level and generating control signals and the suction signals in response to the comparison, and a time determining unit for determining a time period to maintain the generated suction signals;

an integral PWM controller for outputting PWM signals such that the current flowing through the coil is controlled in response to the generated control signals; and a switching unit for switching the current flowing through the coil in response to the output PWM signals such that the current is conducted or blocked; and wherein:

the integral PWM controller is is further for receiving a feedback of the current flowing through the coil for outputting the PWM signals such that the current is constant even when a source is overvoltaged; and the integral PWM controller comprises:

a control voltage level controlling unit for controlling a pulse width of the output PWM signals according to the difference between the detected voltage level and the pre-set reference voltage level, a sawtooth generation unit for outputting sawtooth signals for a predetermined period while the control voltage level controlling unit operates, a PWM output unit for comparing the signals output by the control voltage level controlling unit to the output sawtooth signals and outputting the PWM signals in response to the comparison, an overvoltage prevention unit for suppressing a signal level of the signal output by the control voltage level controlling unit, and a temperature compensating unit for compensating for the suppressed signal level of the signals output by the control voltage level controlling unit in response to temperature changes.

2. The coil-driving apparatus of claim 1, wherein the integral PWM controller further comprises an Integrated Circuit (IC) used exclusively for PWM.

3. A coil-driving apparatus of an electronic magnetic contactor, the coil-driving apparatus comprising:

an input power processing unit for converting an input power to a direct current power;

an input voltage detecting unit for detecting a voltage level of the direct current power output by the input power processing unit;

an operation control unit comprising:

a comparing unit for comparing the detected voltage level to a pre-set reference voltage level, generating control signals and suction signals in response to the comparison, performing a suction operation according to the suction signals, and a time determining unit for determining a time to maintain the generated suction signals;

an integral Pulse Width Modulation (PWM) controller for outputting PWM signals such that a current flowing through a coil is controlled according to the generated control signals; and a switching unit switchable in response to the output PWM signals and configured to conduct or block the current flowing through the coil, wherein:

the integral PWM controller is further for receiving feedback of the current flowing through the coil for outputting the PWM signals such that the current is constant even when a source is overvoltaged; and the integral PWM controller comprises:

a control voltage level controlling unit for controlling a pulse width of the output PWM signals according to a difference between the detected voltage level and the pre-set reference voltage level, a sawtooth generation unit for outputting sawtooth signals for a predetermined period while the control voltage level controlling unit operates, a PWM output unit for comparing the output signals to the output sawtooth signals and outputting the PWM signals in response to the comparison, an overvoltage prevention unit for suppressing a signal level of the signals output by the control voltage level controlling unit, and a temperature compensating unit for compensating for the suppressed signal level of the signals output by the control voltage level controlling unit in response to temperature changes.

* * * * *